US005443174A

United States Patent [19]

Bauer

[11] Patent Number: 5,443,174

[45] Date of Patent: Aug. 22, 1995

[54] ZIP-TOP CAN WITH SPOON

[76] Inventor: Richard G. Bauer, 6848 N. Tara Rd., Federalsburg, Md. 21632

[21] Appl. No.: 226,569

[22] Filed: Apr. 12, 1994

[51] Int. Cl.[6] ..... B65D 51/24

[52] U.S. Cl. ..... 220/212; 220/574.1; 220/270; 220/276; 206/541; 426/115

[58] Field of Search ..... 220/212, 574.1, 270, 220/276; 206/541; 426/115

[56] References Cited

U.S. PATENT DOCUMENTS

| | | | |
|---|---|---|---|
| 1,749,658 | 3/1930 | Ault . | |
| 2,433,926 | 1/1948 | Sayre | 426/115 X |
| 2,584,379 | 2/1952 | Chmielewski . | |
| 3,315,803 | 4/1967 | Kalajian . | |
| 3,334,778 | 8/1967 | Saunders | 220/212 |
| 3,550,805 | 12/1970 | Leonforte | 220/212 |
| 3,624,787 | 11/1971 | Newman | 220/212 |
| 4,060,176 | 11/1977 | Tobiasson . | |
| 4,216,875 | 8/1980 | Stanish | 220/212 |
| 5,217,134 | 6/1993 | Saunders | 220/276 |

FOREIGN PATENT DOCUMENTS

| | | | |
|---|---|---|---|
| 3904799 | 9/1990 | Germany | 220/574.1 |
| 4239454 | 8/1992 | Japan | 220/212 |
| 632970 | 11/1982 | Switzerland | 220/212 |

*Primary Examiner*—Allan N. Shoap
*Assistant Examiner*—Stephen Cronin
*Attorney, Agent, or Firm*—Leonard Bloom

[57] ABSTRACT

A container having a zip-top with said top having the contour of a spoon integral with the upper surface of the top. The contour of the spoon being formed by a weakened edge and with the end of the spoon handle being attached to a pull-tab used for removing the spoon.

13 Claims, 7 Drawing Sheets

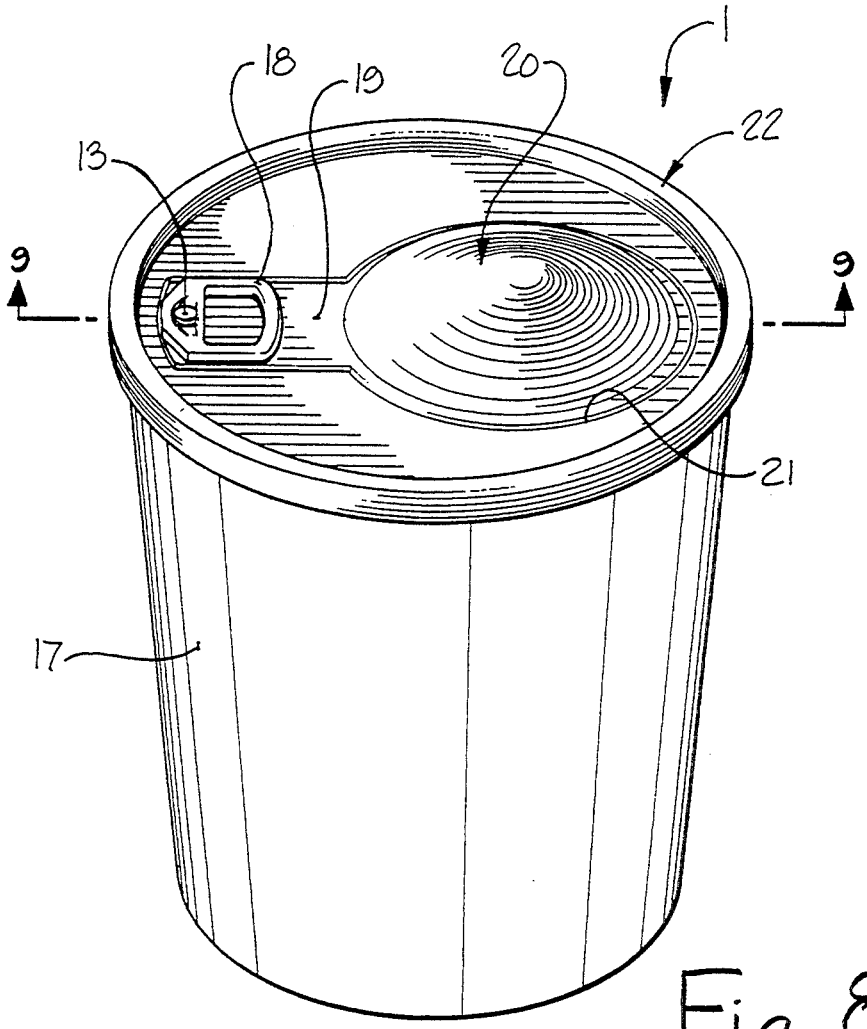
Fig. 8
Fig. 9
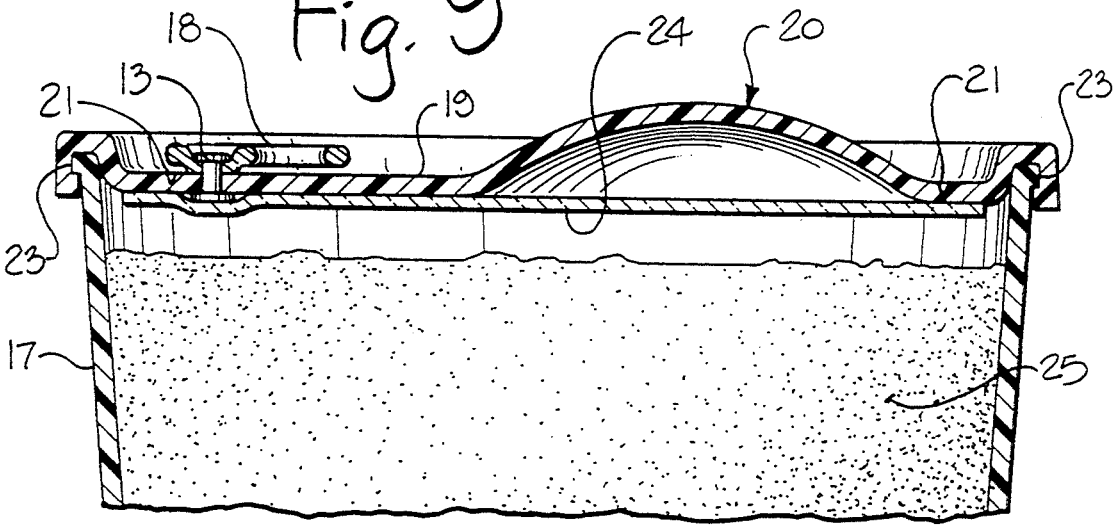

ZIP-TOP CAN WITH SPOON

FIELD OF THE INVENTION

The present invention relates to cans or containers with a zip-top or tab-removable top; and more particularly, to a readily removable top having attached thereto a spoon or other utensil.

BACKGROUND OF THE INVENTION

Metal containers, commonly known as tin cans, are well known to the consumer. They are a convenient way of storing and preserving food and, of course, are well known in every household. Not only are they a common household item, they are a necessity when taking a trip; or camping where food will be needed. And, of course, canned food is an essential for the military.

Cans are useful for the preservation of a vast array of food items. Just about every type of fruit, vegetable or meat is amenable to preparation and packing into a can in processes known as canning.

Conventionally, cans were opened by the use of a can opener operated by hand. In recent years, electric can openers have come into vogue for use in the home. However, conventional hand-held can openers are still used in the field, on picnics and where no electric supply for a can opener is available. Besides the hand-held can opener, another way of opening cans is with the use of a turn-key which latches on to a tab attached to the top of the can. The key is inserted into the tab, and the key turned winding the top of the can around the key. The removal of the top is facilitated by a weakened seam on the top of the can which yielded when the key turned and thus the top is removed.

A major advance in can-container technology came about by the advent of the zip-top can. The zip-top can is a can which has a pull-tab or pull ring attached to the top of the can. The top of the can has a weakened seam so that when the tab or ring is pulled, the top separates from the rest of the can at the weakened seam, thus exposing the contents in the can. The popularity of cans relative to bottles for packaged beverages has increased owing to the development of so-called "easy open" cans of the "pop-top" variety which may be opened by hand without an opener. The tab and opening seam on the can are made so as to be able to open a relatively small aperture or remove the entire top of the can.

Despite the advances in canning technology, there is still a need in the art to supply utensils along with the can for ready use and consumption of the food contents of the can. The prior art leaves much to be desired in solving the problem of supplying utensils along with the canned product.

For example, the prior art as exemplified in U.S. Pat. No. 1,749,658 to Ault discloses a container with a cover onto which is integrally formed a spoon and wherein the spoon is divided from the cover by a weakened line so that a pressure against the spoon portion of the cover will remove the spoon therefrom, with the spoon being used when the contents of the container are eaten.

A utensil attached to a package containing pie is shown by Chmielewski et al in U.S. Pat. No. 2,584,379. The container of Chmielewski et al is used for storing pie and is made of plastic, paper, ceramic or metal. A guard member or slot can be formed on the outside wall of the container so that a fork or other utensil can be slipped in and out of the slot. In another embodiment, a fork is made integral to a wall of the pie plate with the wall being removable and the fork being used to consume the pie. Chmielewski does not show a utensil integral to the top of the container.

The patent to Kalajian, U.S. Pat. No. 3,315,803, discloses a container carton for holding cans of beverage. The carton has perforated, scored or otherwise weakened line to define a handle which is formed when the perforated or scored lines are punched out. No eating utensil is shown outlined by the perforated or scored lines and no pull tab is shown for easy zip-top opening.

U.S. Pat. No. 4,060,176 to Tobiassor shows a food container lid convertible into a spoon for use in eating from the container. While the spoon is removable by perforations, it is only partially removed from the top; and no pull tab is shown to ease the complete removal of the spoon from the top.

None of the prior art set forth above shows the invention described herein.

SUMMARY OF THE INVENTION

Notwithstanding the progress made in the canning art, there is still need to supply a food-can or container with a spoon or utensil attached which would eliminate the need for carrying extra spoons and utensils and would in addition solve the problem of the forgotten spoon. The zip top can with attached spoon finds particular application in away from home use, as for example, when traveling, when camping and when hunting. The zip-top can and spoon of this invention find particular applicability in the military where space is at a premium and convenience is a must. Anyone who has traveled aboard an airplane will immediately recognize the desirability of having a spoon or utensil attached to the container. Not only would such an arrangement be beneficial for supplying the consumer, but would be space-saving on the aircraft.

With all this in mind, the present inventor has invented a zip-top container with a spoon attached. The container has a zip-top surface with an attached first pull-tab. Along the edge of the top is a weakened seam to facilitate the opening of the top when the first tab is pulled. The upper surface or top of the container towards its center has the contour of a spoon integrally outlined thereon. The contour is formed by a weakened seam. The handle end of the spoon is attached to a second pull-tab which when pulled will lift the spoon from the top of the container. The weakened seam for removing the spoon is weaker than the seam for opening the top. The invention is designed so as to be able to remove the spoon first and then the top. In use, the tab on the spoon handle is pulled to remove the spoon. Then the tab on the container top is pulled to remove the cover to expose the contents of the container for consumption by the use of the removed spoon.

The spoon attached to the top can be flat or shaped to form a ladle of various shapes and sizes. The spoon can be fixed on the top of the container with the ladle face-up or face-down. Further, the handle on the spoon can be reinforced with ribs for strength. So far as the position of the pull-tab on the spoon handle and the pull-tab for the container top are concerned, they can be in various relationships to one another, as for example on the same side of the container top or on opposite sides of the top. In a preferred embodiment of this invention, the tabs are on opposite ends of the container top and the end of the container top, where the spoon tab is attached, is unseamed so as to prevent the top surface from being removed along with the spoon. In a special embodiment of this invention, a protective liner is placed under the container top for added protection for the contents of the container.

As an added convenience, the opening tab for the top of the container can be at an apex of the seam contour to facilitate the opening of the container top. While the container, spoon, and pull-tab are shown as being made of metal, plastic is visualized as being a possible substitute material. In addition, a special embodiment of this invention envisions a container wherein a spoon or other utensil is contoured on top by a weakened seam with the handle of the spoon or utensil being attached to a pull-tab to facilitate removal and with the top of the container being removable either by prying, unscrewing, or cutting.

While this invention has been directed primarily to a removable spoon, it is obvious that other eating utensils such as a knife or fork could substitute for the spoon, or that multiple utensils could be placed on the container top. Moreover, in alternative embodiments, the top of the container could be removed by cutting or unscrewing.

BRIEF DESCRIPTION OF THE DRAWINGS

FIG. 5 is a perspective view of zip-top container and attached spoon showing the spoon being lifted from the top by pulling on the spoon's pull-tab.

FIG. 6 is a perspective view of the zip-top container and attached spoon showing the top pull-tab being lifted to remove the top of the container for access to the contents (after the spoon has been pulled off).

FIG. 7 is a pictorial view showing the environment of use of the invention with the spoon and top removed and the spoon being used to consume the contents of the container.

FIGS. 8 and 9 show an alternate embodiment of this invention.

FIG. 8 is a perspective view of a plastic container and lid with a pull-tab to remove the spoon.

FIG. 9 is a cross-sectional view taken along lines 9—9 of FIG. 8, drawn to an enlarged scale, and showing the use of alternate materials in the manufacture of the container and spoon.

GENERAL DESCRIPTION OF THE PREFERRED EMBODIMENT

Figure 1:
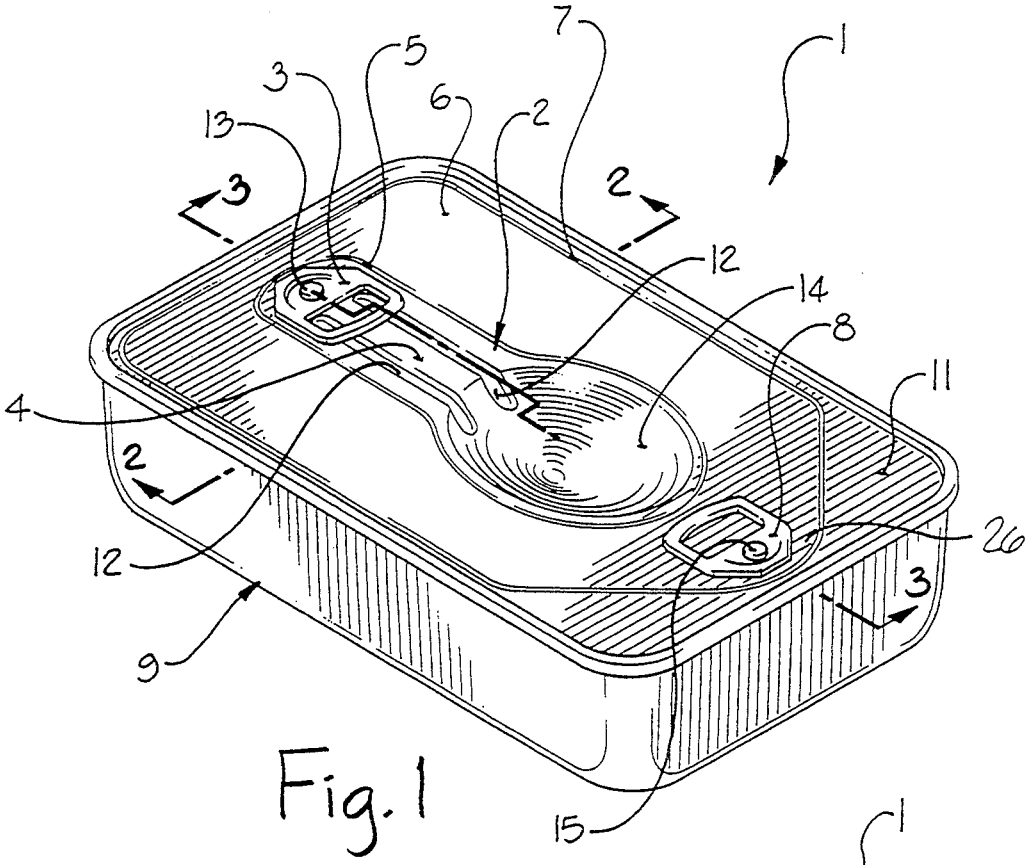
FIG. 1 is a perspective view of the zip-top container and attached spoon of the invention.

With reference to FIG. 1, there is illustrated the invention 1 of the zip-top container and spoon. The figure shows the spoon 2 with spoon pull-tab 3 shown attached to the spoon handle 4. The weakened seam 5 is shown surrounding the spoon 2. The removable top 6 outlined by the less weakened seam 7. The top pull-tab 8 is depicted at apex 26.

Figure 2:
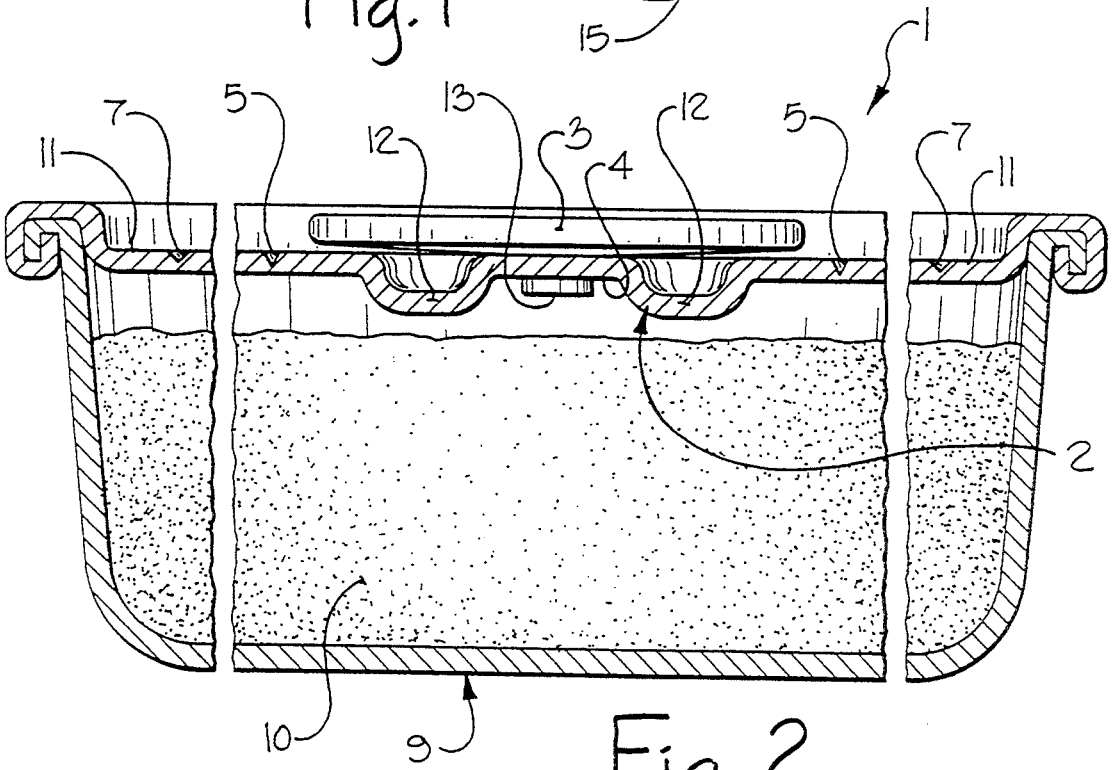
FIG. 2 is a cross-sectional view of the zip-top container and attached spoon taken along the lines 2—2 of FIG. 1 and drawn to an enlarged scale.

Further, with reference to FIG. 2, there is shown the container 9 and spoon 2 of this invention. Detail of the underside of the top 6 and spoon 2 are shown as well as the contents of the container. The figure also shows the part of the top 11 which is not removed. Note particularly that the figure shows the less weakened seam 7 for removal of the top 6 and the more weakened seam 5 for removing the spoon 2. The spoon 2 is shown with reinforcing ribs 12. Attached to the spoon handle 4 is the pull-tab 3 held in place by rivet 13.

Figure 4:
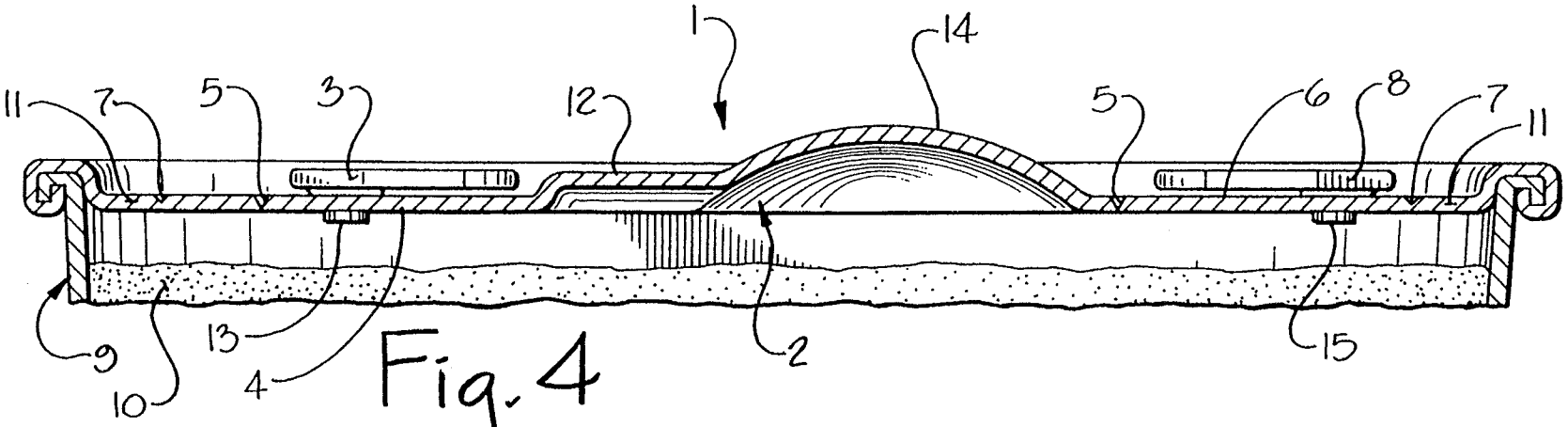
FIG. 4 is an alternate cross-sectional view of the zip-top container and attached spoon taken, substantially similar to that of FIG. 3, but showing the spoon with its concave portion facing down.
Figure 3:
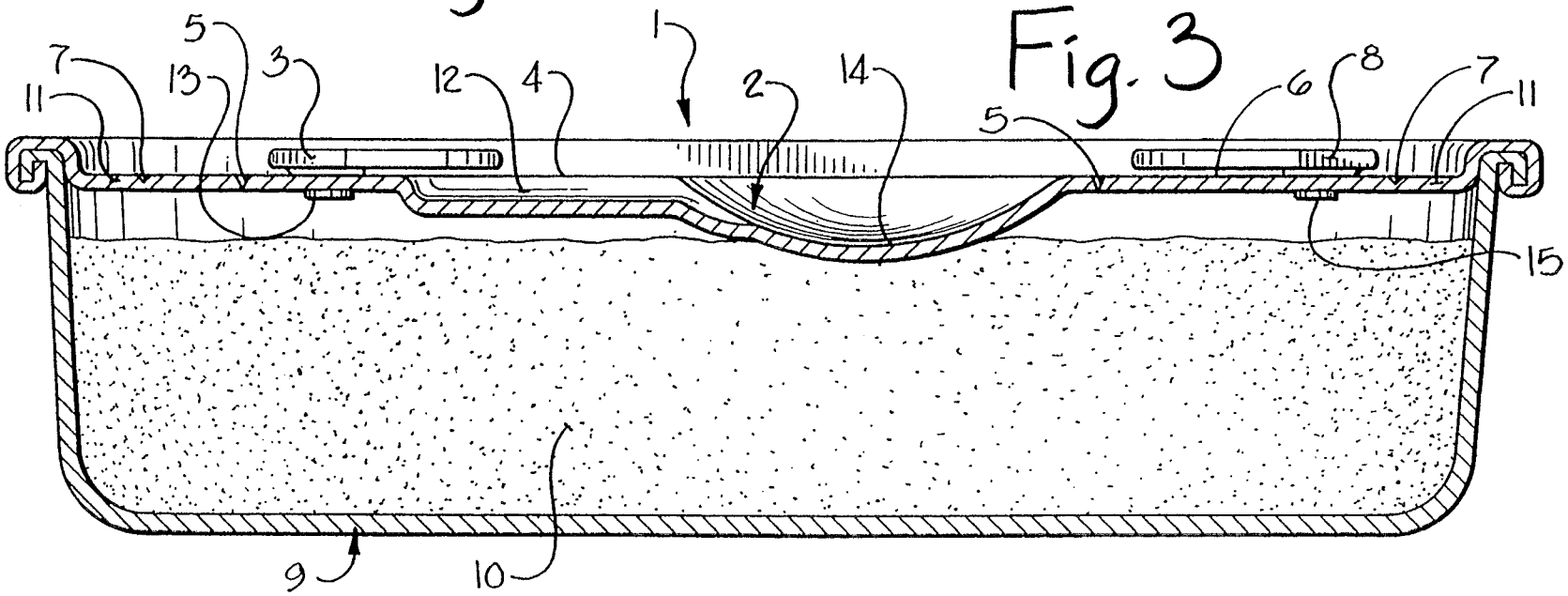
FIG. 3 is a further cross-sectional view of the zip-top container and attached spoon taken along lines 3—3 of FIG. 1, drawn to an enlarged scale, and with part of the container being broken-away. The spoon is shown with the concave portion facing up.

Relative to FIGS. 3 and 4, there are shown two specific embodiments of this invention wherein the ladle 14 of the spoon in FIG. 3 faces up and in FIG. 4 the ladle 14 faces down. Also shown are the pull-tab for the spoon 3 and pull-tab 8 for the top. The spoon tab rivet 13 and the top tab rivet 15 are shown in the figures. Note also that the weakened seam 5 for the spoon and the weakened seam 7 for the top are in the figures.

Figure 5:
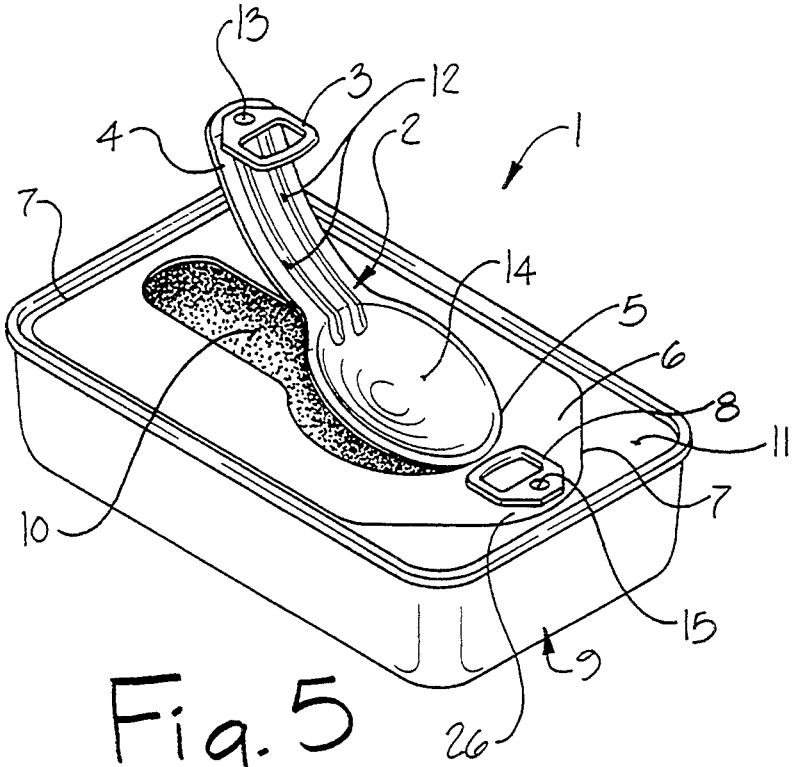
FIGS. 5–7 are sequential views illustrating the use of the present invention.
Figure 6:
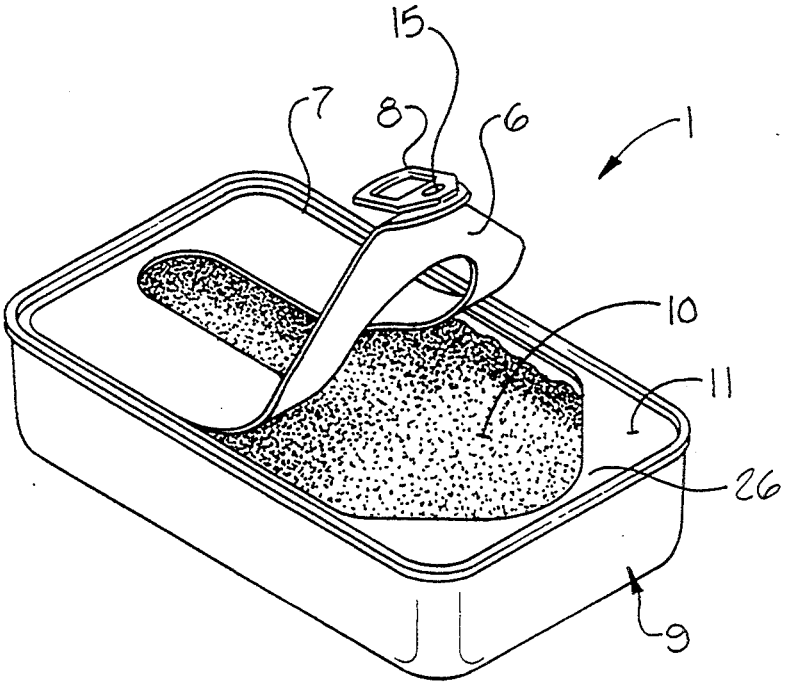
Figure 7:
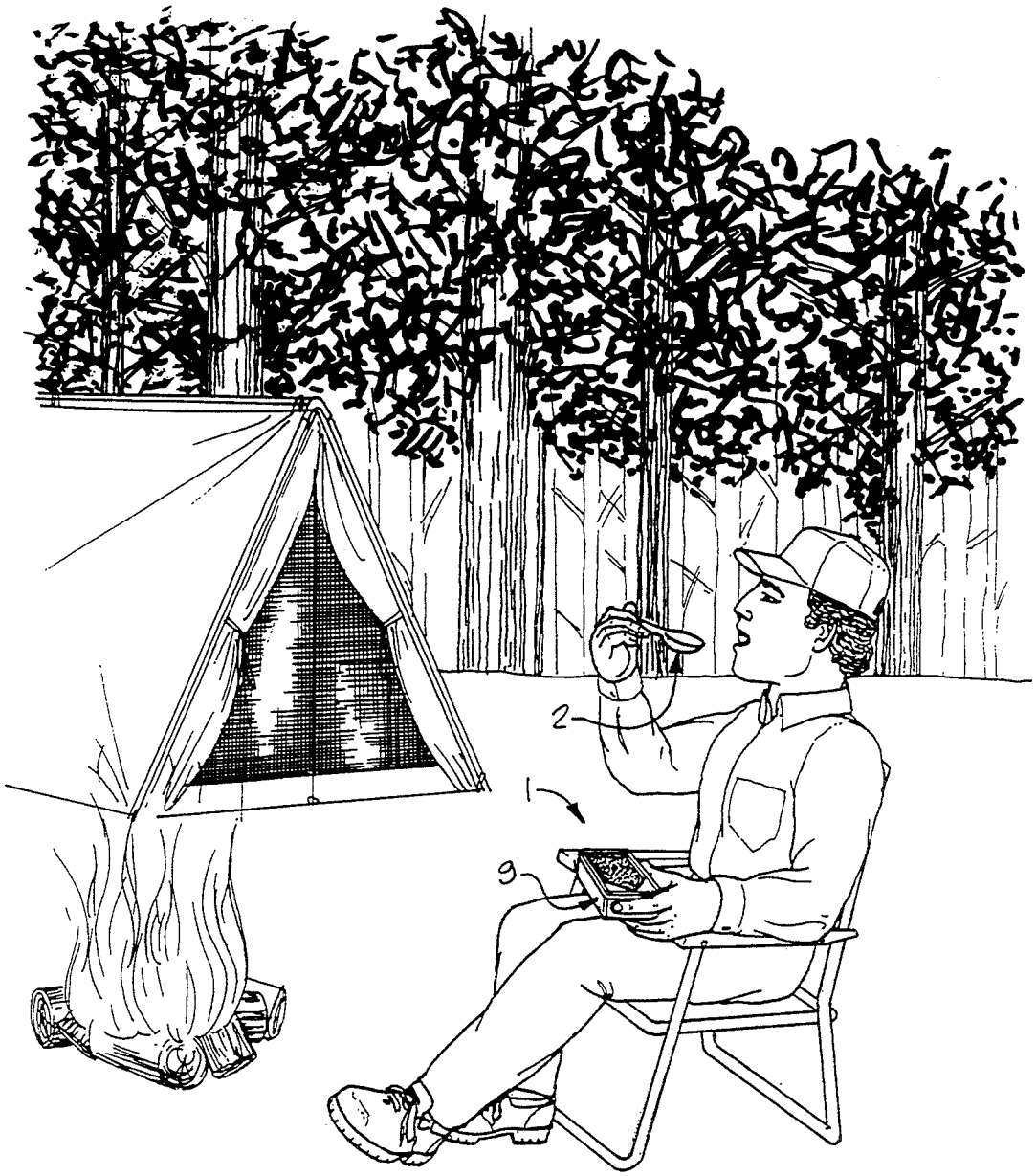

Now referring to FIGS. 5–7, there is shown the method of utilizing the zip-top container and spoon 1 of this invention. In operation, when ready to consume the contents of the container, one pulls tab 3 attached to spoon handle 4 and lifts causing the more weakened seam 5 around the spoon 2 to yield and the spoon 2 to be lifted out, ready for use (FIG. 5). Next, the pull-tab 8 for the top 6 is pulled with the less weakened seam 7 for the top 6 yielding to remove top 6 (FIG. 6). Having removed the spoon 2 and the top 6, the contents 10 of the container 9 can be consumed as shown in FIG. 7.

With further reference to FIGS. 8 and 9, there is shown an alternative embodiment of this invention drawn to a round cup-like container 17 with a tab 18 attached to the spoon handle 19. The spoon 20 is removed by lifting tab 18 and breaking the weakened seam 21 to remove the spoon 20. After the spoon 20 is lifted, the lid 22 is pried from flange 23 on the cup-container 17. Note particularly that the cup 17, lid 22, and spoon 20 shown in FIGS. 8 and 9 are plastic. Note especially that FIG. 9 shows a liner 24 under the lid 22 to seal contents 25 of the cup once the spoon is removed. This feature facilitates shelf life as well as storage of the contents of the container when only a portion of the contents is consumed.

Figure 10:
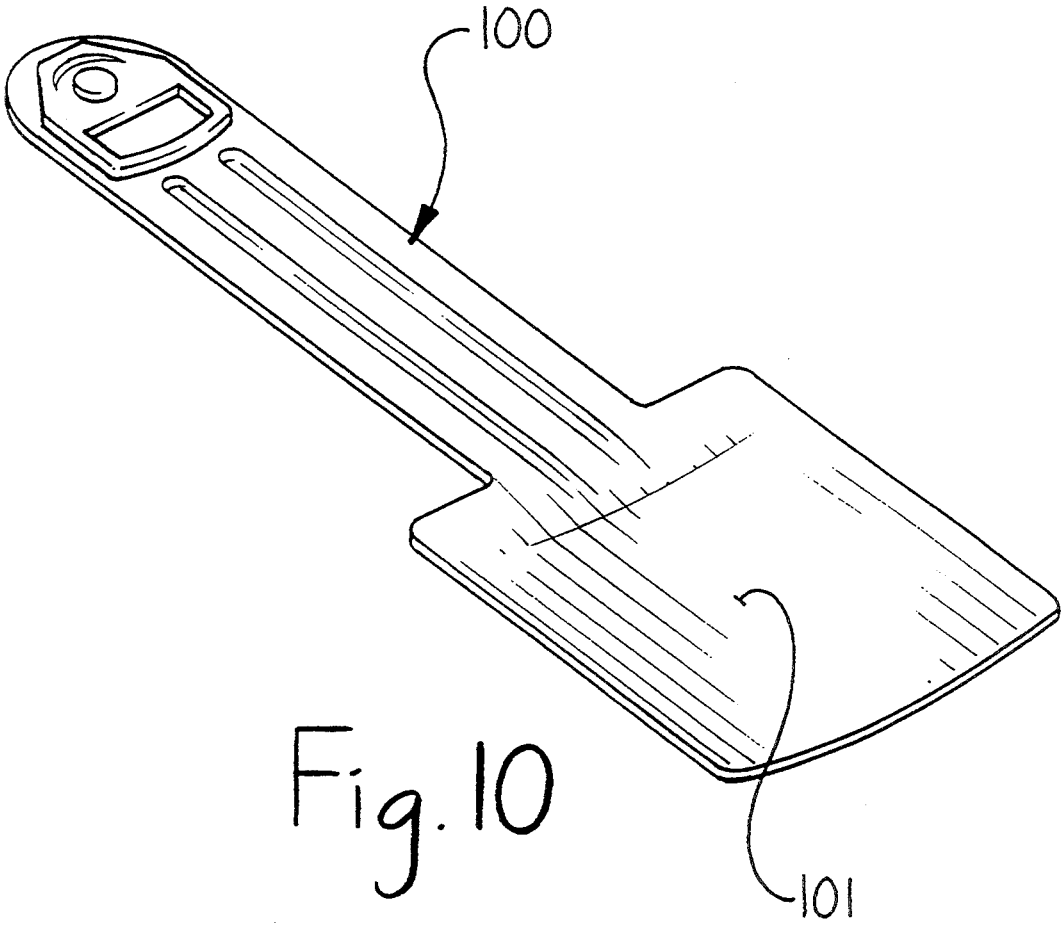
FIG. 10 is an alternate embodiment of the spoon.

With reference to FIG. 10, an alternate embodiment of the spoon 100 has a flat spade-type portion 101 which is slightly concave.

Figure 11:
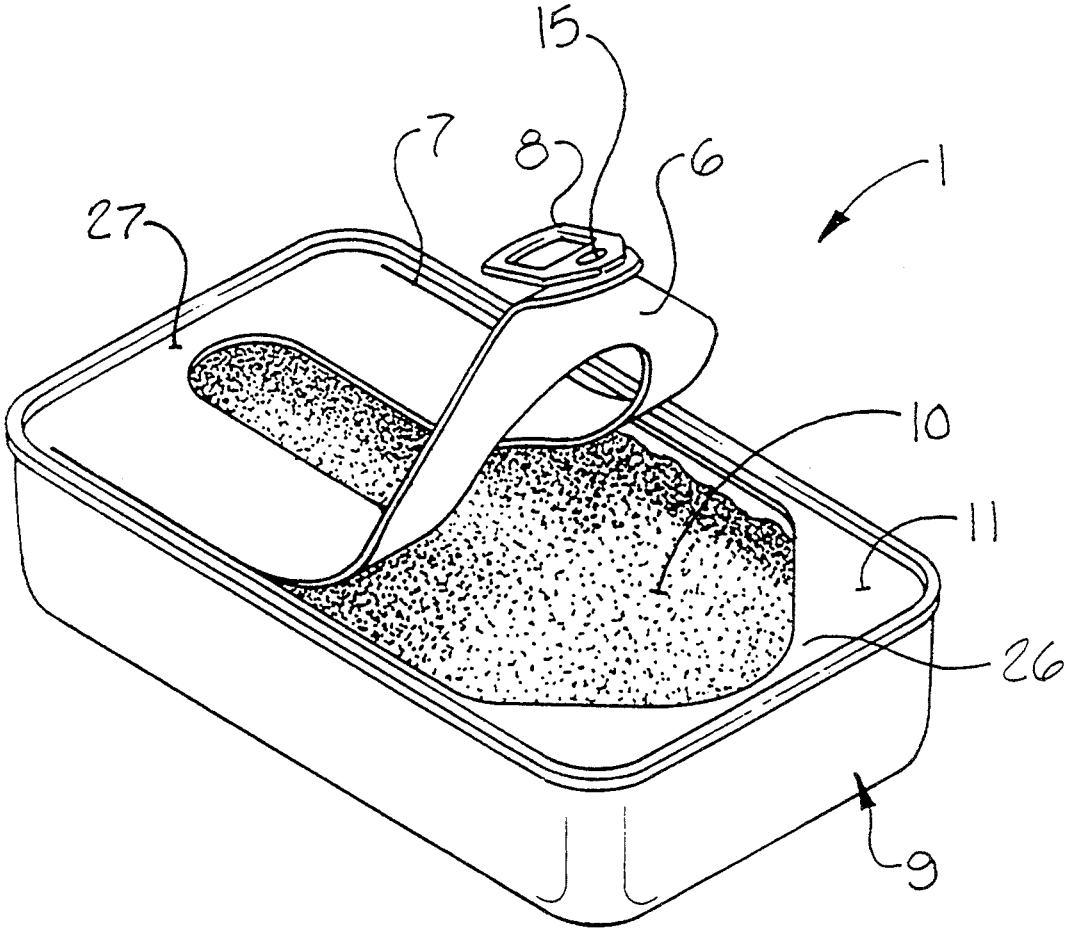
FIG. 11 is a perspective view of the zip-top container and spoon showing the edge of the container at the end opposite the pull-tab for the spoon as being unseamed.

The zip-top container 1 has a removable top 6 wherein the top 6 at the edge of the container 1 where the pull-tab 3 for the spoon 2 is attached is unseamed 27 (FIG. 11). The unseamed portion 27 of the removable top 6 is of benefit in preventing the top 6 of the container 1 from being removed along with the spoon 2 when the pull-tab 3 for the spoon 2 is pulled.

It is obvious that the spoon integrally attached to the top of the container can be placed at random locations on the top of the container.

Obviously, many modifications may be made without departing from the basic spirit of the present invention.

Accordingly, it will be appreciated by those skilled in the art that within the scope of the appended claims, the invention may be practiced other than has been specifically described herein.

What is claimed is:

1. A zip-top container and attached spoon comprising a container having a zip-top attached to a first pull-tab, wherein along the zip-top of the container there is an edge provided which is a first weakened seam which will part to open the zip-top when the first pull-tab is pulled, the zip-top of the container having the contour of a spoon unitarily formed within the zip-top, said contour of the spoon being formed by a second weakened seam along the outline of the spoon, and the spoon including a handle having an end provided with a second pull tab to facilitate the removal of the spoon by pulling the second pull-tab.

2. The zip-top container and attached spoon of claim 1 wherein the spoon is substantially flat.

3. The zip-top container and attached spoon of claim 1, wherein the spoon has a concave portion contoured to form a ladle.

4. The zip-top container and attached spoon of claim 3, wherein the concave portion of the ladle faces down.

5. The zip-top container and attached spoon of claim 3, wherein the concave portion of the ladle faces up.

6. The zip-top container and attached spoon of claim 3, wherein the handle of the spoon is reinforced with ribs for strength.

7. The zip-top container and attached spoon of claim 1, wherein the first pull-tab for the top and the second pull-tab for the spoon are on opposite ends of the top of the container.

8. The zip-top container and attached spoon of claim 1, wherein the container has an end, and wherein the edge of the container at the end where the second pull-tab for the spoon is attached is unseamed so as to prevent the zip-top of the container from being removed along with the spoon when the second pull-tab for the spoon is pulled.

9. The zip-top container and attached spoon of claim 1, wherein the second weakened seam for removing the spoon is more weakened than the first weakened seam for removing the top, such that only the spoon will be removed when the second pull-tab for the spoon is pulled.

10. The zip-top container and attached spoon of claim 1, wherein the zip-top of the container has an apex, and wherein the first pull-tab for the zip-top of the container is within the apex to facilitate the opening of the zip-top of the container.

11. The zip-top container and attached spoon of claim 1 having a protective sheet liner under the top surface of the container.

12. A zip-top container and attached spoon comprising a container having a zip-top attached to a first pull-tab, wherein the zip-top of the container has an edge provided with a first weakened seam which will lift to open the zip-top when the first pull-tab is pulled, the zip-top of the container having the contour of a spoon unitarily formed within the zip-top, said contour of the spoon being formed by a second weakened seam along the outline of the spoon, the spoon including a handle being provided with a second pull-tab at the end of the handle to facilitate the removal of the spoon by pulling the second pull-tab, the spoon having a contoured portion to form a ladle, and the first pull-tab for the top and the second pull-tab for the spoon being on opposite ends of the top of the container.

13. A method for the convenient supply and consumption of canned food comprising supplying a zip-top container having a weakened seam contouring the container top to be opened, said top having a tab which will be pulled to open said top, said top having the contour of a spoon unitarily formed within the top of the container set forth on the upper surface of the top with said contour of the spoon being formed of a weakened seam and when it is desired to consume the contents of the container, a tab on the spoon handle is pulled to lift the spoon off of the top and then a second tab is pulled to lift the top of the container and finally the contents of the container are eaten by using the spoon which was attached to the top of the container.

* * * * *